United States Patent [19]

Howard

[11] Patent Number: 4,622,770

[45] Date of Patent: Nov. 18, 1986

[54] OPEN-CLOSED SIGN

[76] Inventor: John Howard, 2230 Durant Ave. #204, Berkeley, Calif. 94704

[21] Appl. No.: 700,492

[22] Filed: Feb. 11, 1985

[51] Int. Cl.[4] ..... G09F 11/00

[52] U.S. Cl. ..... 40/491; 40/488

[58] Field of Search ..... 40/491, 488, 907

[56] References Cited

U.S. PATENT DOCUMENTS

| | | | |
|---|---|---|---|
| 2,897,617 | 8/1959 | Haupt | 40/491 |
| 3,111,782 | 11/1963 | Quigley | 40/491 |
| 3,650,055 | 3/1972 | Bult, III | 40/907 |
| 3,748,767 | 7/1973 | Giesecke | 40/907 |
| 4,177,593 | 12/1979 | Lockey | 40/491 |
| 4,217,713 | 8/1980 | Greenberger | 40/491 |
| 4,485,576 | 12/1984 | Greenberger | 40/491 |

FOREIGN PATENT DOCUMENTS

| | | | |
|---|---|---|---|
| 745356 | 5/1933 | France | 40/491 |
| 441846 | 1/1936 | United Kingdom | 40/491 |
| 1176837 | 1/1970 | United Kingdom | 40/488 |

*Primary Examiner*—Robert P. Swiatek
*Assistant Examiner*—Cary E. Stone
*Attorney, Agent, or Firm*—Limbach, Limbach & Sutton

[57] ABSTRACT

A compact "OPEN-CLOSED" sign is disclosed, consisting of multiple panels overlying one another and slidable to display "OPEN" or "CLOSED" depending on the relative locations of the panels. The letters "O" and "E" are displayed in either covered or displayed according to the apertures in the top two panels.

3 Claims, 3 Drawing Figures

OPEN-CLOSED SIGN

BACKGROUND

Virtually every retail establishment in the United States displays a sign to indicate whether it is open or closed for business. Most signs are printed with the word "OPEN", and perhaps a message, on one side, and "CLOSED" on the other side. The proprieter simply turns the sign over when opening or closing for the day.

More sophisticated "OPEN-CLOSED" signs are known to the art. U.S. Pat. No. 3,650,055 shows a sign slidable up and down in two channels and rotatable through 180 degrees to reveal the opposite side of the sign. However, space must be provided behind the sign to accommodate the swinging of the sign and its head element during the reversing process. Another "OPEN-CLOSED" sign is shown in U.S. Pat. No. 3,748,767 where both words are printed on a back panel, and a slidable front panel covers the inappropriate word. Space is required to display both words side by side, so the size of the letters displayed is limited by the width of the surface carrying the sign. Neither of these prior art signs is designed to show the words in letters large enough to be viewed from a distance, such as in a window of a gas station to be viewed from the street.

It is an object of the present invention to provide a compact display of the words "OPEN" and "CLOSED" that does not require space for substantial movement of the sign or covers, whereby the size of the letters may occupy a substantial portion of the space available.

It is a further object of the invention to allow the use of very large letters in relation to the size of the sign to permit easy reading from a distance. For example, letters three inches wide and five inches high by be viewed from a considerable distance. With the present invention, a sign with such large letters may be placed in a 24 inch door window. The size and distance away may be relatively small, as in a fireplace damper indicator, or relatively large, as in a sign for a gas station that can be viewed from the street.

SUMMARY OF INVENTION

This invention relates to a compact sign capable of providing maximum readability from an inconspicuous sign. The sign consists of three panels: a back panel containing six display spaces, the middle having seven display spaces and the front having an aperture six spaces wide and a width of at least eight spaces. To display the words "OPEN" and "CLOSED", the first space in the back panel should be blank, the second has the letter "L" displayed, the third has the letter "P", the fourth has the letter "S", the fifth has the letter "N" and the sixth has the letter "D". The middle panel should be slidable between a left mode and a right mode, and should have seven spaces, the first with the letter "C", the second, fourth and sixth spaces being apertures for looking through the middle panel to the corresponding spaces on the back panel, the third space has the letter "O", the fifth has the letter "E" and the seventh space is blank. The front panel has at least eight display spaces, the first one and left one being blank, and the next six being apertures for viewing what is behind on either the middle or back panel.

DRAWINGS

DESCRIPTION OF THE PREFERRED EMBODIMENTS

Figure 1:
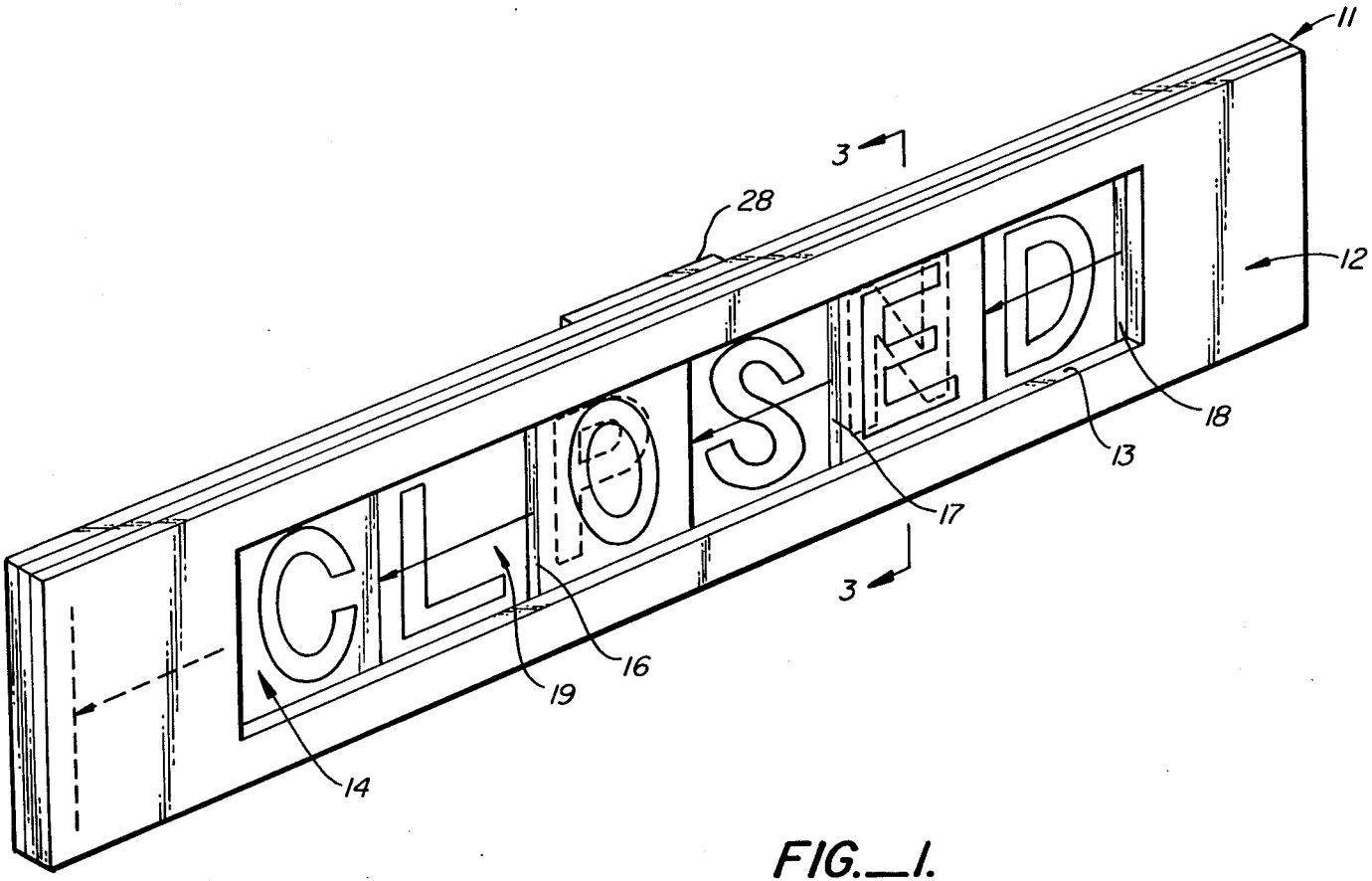
FIG. 1 is an isometric view, partially in phantom, of a sign embodying the present invention.

As shown in FIG. 1, sign 11 consists of a front panel 12 having an aperture 13, through which a portion of middle panel 14 may be viewed. Middle panel 14 also has three apertures 16, 17 and 18 through which the back panel 19 may be viewed. Middle panel 14 is adapted to move one space from right to left to the position shown by the arrows in FIG. 1.

In the position shown in FIG. 1, the word "CLOSED" is formed from the letters "C", "O" and "E" on the middle panel 14, and the letters "L", "S" and "D" on the back panel 19 as viewed through apertures 16, 17 and 18 in middle panel 14. When middle panel 14 is moved to the left in the manner shown by the arrows, the letter "C" is obscured by the solid left end zone 21 of front panel 12. The aperture 16 in middle panel 14 is moved to show a blank space 22 on back panel 19 to the left of the letter "L" (FIG. 2).

When middle panel 14 is shifted to the left or "OPEN" mode, the first letter seen is "O" on middle panel 14 which overlies the letter "L" on back panel 19. The aperture 17 between letters "O" and "E" on middle panel 14 exposes the letter "P" on back panel 19, shown in phantom in FIG. 1. The letter "E" then covers the letters "S", and aperture 18 in middle panel 14 shows letter "N" on back panel 19. The letter "D" on back panel 19 is covered by a blank space 23 to the right of aperture 18 of panel 14, best seen in FIG. 2. In the right on "CLOSED" mode, the blank space 23 to the right of aperture 18 of panel 14 is behind the solid area 24 of front panel 12 to the right of aperture 13.

Figure 2:
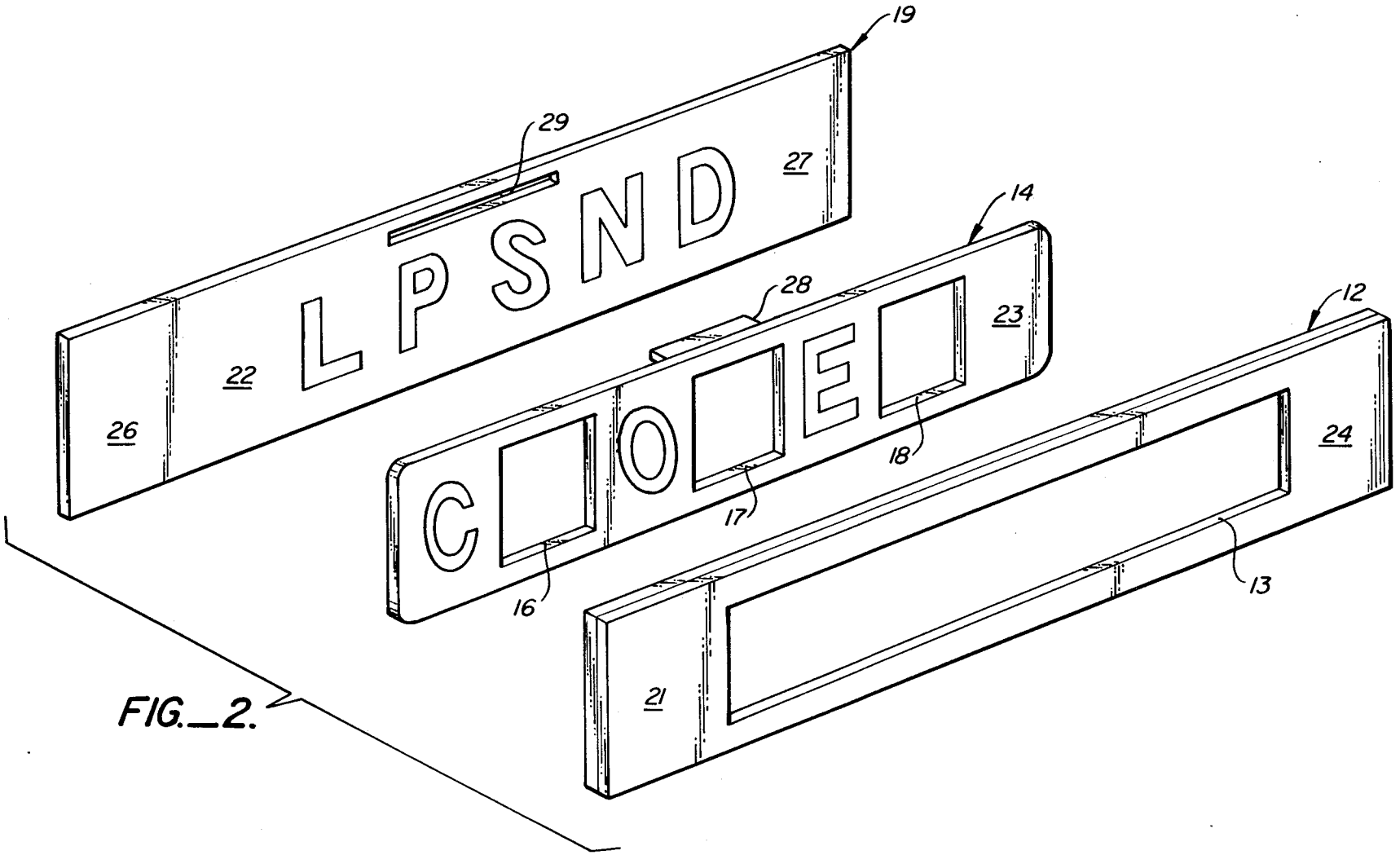
FIG. 2 is an exploded isometric view of the sign in FIG. 1.

As shown in FIG. 2, front panel 12 is at least eight spaces wide, allowing an aperture 13 six spaces wide and two solid end zones 21 and 24 designed to cover one of the end spaces of middle panel 14, either "C" or blank space 23, depending upon whether it is in the left "CLOSED" mode, or the right "OPEN" mode. Panel 14 is only seven spaces wide to allow movement between the left and right modes.

Back panel 19 is the same width as front panel 12, that is, wide enough to accommodate eight spaces. However, only five of the spaces on panel 19 bear letters. The first two spaces 26 and 22 are blank, the letters "L", "P", "S", "N" and "D" occupy the next five spaces, and the last space 27 is blank.

Movement of middle panel 14 may be accomplished in a variety of ways. As illustrated, a tab 28 may be attached to the back of middle panel 14 to extend through a slot 29 in back panel 19. Slot 29 must be long enough to permit movement of tab 28 and panel 14 one full space between the left "CLOSED" mode and the right "OPEN" mode. It is convenient to make tab 28 and slot 29 the limits for precise registry of the words displayed. That is, tab 28 is a detent moving between limits at each end of slot 29.

Figure 3:
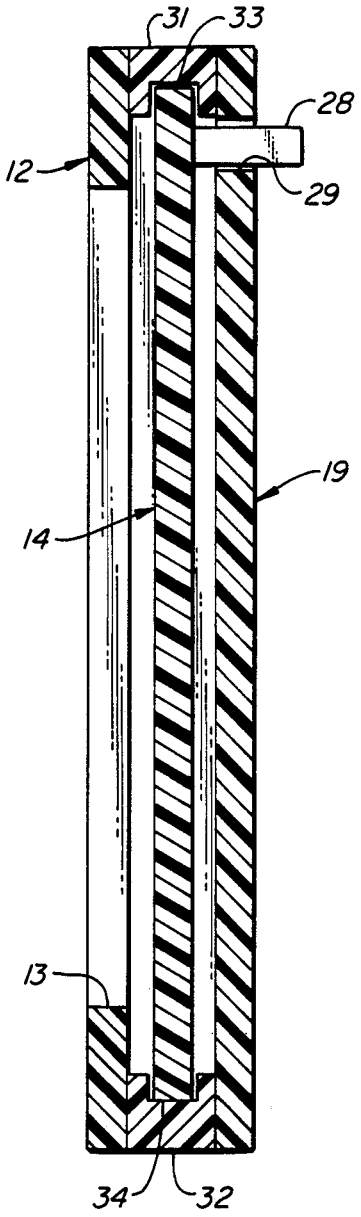
FIG. 3 is a cross-section view taken along line 3—3 of FIG. 1.

FIG. 3 shows in section that tab 29 is bonded to middle panel 14 and protrudes through slot 29 in back panel 19. The personnel at the retail establishment may adhere the sign to a window in front of panel 12 and manipulate tab 29 to the right or left to display the desired word. Where the sign is used in a context where front manipulation is desired, such as a small sign at the top of a fireplace opening to reveal flue damper position, tab 29 may be mounted on the front of panel 14 to protrude through a corresponding slot (not shown) in front panel 12 of the sign.

FIG. 3 also shows spaces 31 and 32 to separate front and back panels 12 and 19 sufficiently to allow ready movement of middle panel 14. As illustrated, spaces 31 and 32 have channels 33 and 34, respectively, to maintain panel 14 at a distance from both front panel 12 and back panel 19 so that the letters are not worn off by friction. Other suitable spacing means may be used, depending on the materials used.

FIG. 3 is lined to indicate plastic construction, but metals, such as brass or steel, cardboard, leather or other rigid materials may be used. A preferred material is laminated plastic of the type commonly used for laminated rulers and drafting equipment. It typically has transparent top and bottom layers to protect a central sandwich layer bearing printed information. he apertures shown in the drawing may be actually cut out, as with a cardboard or metal construction, or simply left as transparent panels in an otherwise opaque layer sandwiched between two transparent plastics laminated. With any material, it is useful to round the corners of middle panel 14 to facilitate sliding.

When the sign is mounted on the inside of a storefront window, it may be permanently affixed with adhesive, suction cups, or other suitable means. In such a configuration, the back of the middle panel 14 may conveniently bear a legend in small letters to show through slot 29 adjacent to tab 28 to indicate whether the word displayed is "OPEN" or "CLOSED".

While the specific embodiment related to the commonplace words "OPEN" and "CLOSED", it will be apparent that the same concept may be used with other designations having common letters or numbers to provide a compact changeable sign. It is contemplated that equivalent signs be within the scope of the invention defined by the following claims.

I claim:

1. In a sign intended to convey the words "OPEN" or "CLOSED" alternatively, the improvement comprising (1) a back panel containing six display spaces; the first being blank, the second bearing the letter "L", the third "P", the fourth "S", the fifth "N" and the sixth "D"; (2) a slidable middle panel, shiftable between a left mode and a right mode containing seven display spaces corresponding in size to those in the back panel; the first bearing the letter "C", the second, fourth and sixth spaces being apertures for viewing through the middle panel to the back panel, the third space bearing the letter "O", the fifth bearing the letter "E", and the seventh being blank; (3) a front panel having a width of eight spaces corresponding in size to those of the middle and back panels enclosing an aperture six spaces in width and a solid panel on each side of the aperture at least as wide as a single space, whereby the left-hand solid front panel covers the letter "C" of the first space of the middle panel when the middle panel is shifted to the left-hand mode of the sign as viewed from the front and (4) registry means to allow the aperture of the front panel to display the word "OPEN" when the middle panel is in the left mode and the word "CLOSED" when the middle panel is in the right mode.

2. A sign as in claim 1 wherein the back panel has an opening sufficiently wide to accomodate a detent on the middle panel in either left or right mode, whereby the detent can control registry of the panels between left and right modes.

3. A sign as in claim 1 wherein the apertures in the front and middle panels are clear areas of transparent plastic in an otherwise opaque panel.

* * * * *